United States Patent [19]

Bergmann

[11] 4,426,925

[45] Jan. 24, 1984

[54] APPARATUS FOR COMPACTING TRASH IN OPEN CONTAINERS

[76] Inventor: Heinz Bergmann, Im Ründerdiek 1, D4474 Lathen, Fed. Rep. of Germany

[21] Appl. No.: 274,782

[22] Filed: Jun. 18, 1981

[30] Foreign Application Priority Data

Jun. 24, 1980 [DE] Fed. Rep. of Germany ..... 3023508
Feb. 27, 1981 [DE] Fed. Rep. of Germany ..... 3107383

[51] Int. Cl.[3] ..... B30B 3/02; B65G 3/04

[52] U.S. Cl. ..... 100/65; 100/68; 100/210; 56/344

[58] Field of Search ..... 100/67, 68, 210; 68/102; 414/300, 313; 56/344, 346

[56] References Cited

U.S. PATENT DOCUMENTS

| | | | |
|---|---|---|---|
| 3,720,052 | 3/1973 | Anderson et al. | 56/346 |
| 3,881,409 | 5/1975 | Frigieri | 100/210 X |
| 3,910,438 | 10/1975 | Anderson et al. | 100/210 X |
| 3,922,838 | 12/1975 | Kline et al. | 56/344 |
| 4,036,125 | 7/1977 | Mezei | 100/210 X |

*Primary Examiner*—Peter Feldman
*Attorney, Agent, or Firm*—Wells & Wells

[57] ABSTRACT

Equipment for compacting trash, in particular cardboard cartons or the like, in upwardly open containers, characterized in that a compacting roll (4) moving to-and-fro on the trash (2) in the container (1) is provided which is rotatably supported from the free end of a pivot arm (5) mounted in articulating manner to a post (6) and of which the telescoped length (L) is adjustable.

34 Claims, 12 Drawing Figures

APPARATUS FOR COMPACTING TRASH IN OPEN CONTAINERS

BACKGROUND OF THE INVENTION

The invention relates to apparatus for compacting trash, in particular cardboard boxes or the like in upwardly open containers.

Containers of the cited kind are used in particular to pick up paper or cardboard wastes, especially at businesses and warehouses, to allow their removal .

To-date such containers have been filled merely by hand, and the compaction has taken place by the inherent weight of the cardboard, papers etc. deposited into the containers. The method suffers from the drawback that the capacity of a container is not fully utilized on account of the cardboard and the like loosely lying on top of each other, and that therefore the volume of cardboard possibly filled is not reached.

SUMMARY OF THE INVENTION

It is therefore the object of the invention to create apparatus permitting to compact in a simple manner cardboard, cartons and the like in such containers at the site of loading, whereby the container shall hold as large an amount as possible of the wastes to be removed, namely in particular all of the packing material which collects at such businesses or warehouses.

This problem is solved by the invention in that a driven compacting roll moving to-and-fro in the container is provided, which is rotatably supported at the free end of a pivot arm born in articulating manner by a post, where the projecting length of this pivot arm is variable.

Such apparatus permits the to-and-fro motion of the driven roll across the trash in the longitudinal direction of the container, the pivot arm being extended or shortened depending on the relative distance between the roll and the support of the pivot arm at the post. In this exceedingly simple manner the trash is consecutively compacted in the container, which thereby is capable of taking in substantially larger amounts of trash than possible by the previously used methods of loose filling.

The roll may be a hollow drum closed at its end faces, with the roll material being steel plate such that depending on the thickness and for a diameter of about 80 cm, a weight of the order of 200 to 300 kg will result. It is enough, therefore, that the driven roll lie by its own weight on the trash to be compacted. No additional pressure on the roll is required.

It is particularly advantageous to place the roll drive means inside of it, as in this manner the roll weight is further increased by the drive motor and additionally provided transmission gears. The drive means appropriately may comprise a spur-gear system mounted centrally in the roll and solidly fixed to the free end of the pivot arm together with drive motor. Two outer rotatably supported hollow sections of the roll join the central one.

The drive motor is appropriately mounted eccentrically with respect to a through-going shaft driven by the spur-gear system, the drive motor being located laterally off the shaft and penetrating one of the two hollow sections.

As shown by experiment, the roll drive mode may be so designed that the roll rotates at 25 rpm for a diameter of about 80 cm. The centrally spatially fixed section of the roll may be formed by the transmission gear housing or by a cover of this housing at the same time forming the bearing for the two rotatable hollow sections of the roll, i.e. for its shaft.

Advantageously the change in length of the pivot arm is implemented in such a manner that the pivot arm consists of single segments telescoping with respect to each other. In this manner the distance between the roll axis and the upper support of the pivot arm varies in the course of the horizontal motion over the trash to be compacted by the individual telescope segments being pushed into each other, the pivot arm assuming its minimum length when passing the post that supports it.

Again it is advantageous to provide the post supporting the pivot arm with a hydraulic jack allowing to move up and down the support point for the upper end of the pivot arm. Thereby it becomes possible to balance the stacked height within the container by more or less raising the support point of the pivot arm depending on the amount of trash already in the container.

To ensure that there be no collision between the driven roll and the container wall, it is advantageous that the length of the pivot arm from its upper support point to its lower free end the roll radius be slightly less than half the length of the container. In this manner the roll is prevented from running against the container wall even when the pivot arm in its particular end positions makes a very shallow angle with respect to the horizontal.

Other embodiments are additionally possible, wherein by the use of limit switches or the like the sideways motion of the roll is restricted and its direction of rotation is automatically reversed at those end positions.

The hydraulic jack in the post of the equipment of the invention also is used to introduce the roll in the container and to remove it from it, provision being made if desired for a segment of the pivot arm projecting beyond the roll above the support point at the post that can be connected in articulating manner by a linkage, a chain or the like by means of its end away from the support point to the post for the swung-out position of the pivot arm. If such an articulating connection is provided, then the lifting of the support point results in swinging the pivot arm upward out of the container, while conversely a lowering of the support point results in very rapidly lowering the pivot arm into the container. Due to the length of the pivot arm, the stroke of the hydraulic means is enlarged by the various lever-arm lengths when the lever arm is swung out.

If, as discussed above, the pivot arm has a telescoping design, it may be especially advantageous that the last telescoping hollow segment form the particular arm projecting beyond the support point and which is engaged by the linkage system or the chain.

Even though it is possible to mount the post to the end faces of the container, it is especially advantageous that the post be located midway with respect to the container and have an arm spanning above the container, the support point of the pivot arm being arranged at the free end of that arm. To keep the post reliably fixed in position during the compacting motions, it will be advantageously provided with a substantial base plate passing underneath the container which sits on it. In this manner the weight itself of the container ensures that the post be held fixed. Additionally, interlocking pawls or the like may be used as connecting means between the base plate and the container.

To that end, the base plate in particular may be so designed as to be provided at one end face with a stop rail overlapping from below the corresponding end face of the container and against which the container is moved by means of an obliquely downward displacement until it comes to a stop where it is ready for use. In this manner the base plate, the post and the container are always so arranged into each other that the post is located midway in the container. The container may be removed in the opposite direction from this base plate so designed by a slanted upward lifting motion, during which appropriately the roll is located on that side which is away from the crane or other device hoisting the container in order to avert collision with the wall while the container is being hoisted.

Appropriately the drive motor for the roll is a reversible motor so that the switch-over at the end positions the roll moves back over the trash. This switch-over can be manually controlled, or else by limit switches actuated in those end positions. These limit switches can be actuated by the pivot arm or by attachments mounted on the pivot arm provided the pivot arm always perform the same excursions, which assumes that the lifting means at the post always raises by a given value the support point of the pivot arm for the individual consecutive to-and-fro motions of this pivot arm.

This lifting can be implemented in an especially advantageous manner in that during the inward telescoping of the pivot arm, the pivot arm moves against a stop means and upwardly displaces the ram of the hydraulic jack bearing the support point of the pivot arm when the hydraulic jack is in the floating position. By switching on a check-valve retaining the hydraulic oil displaced on the side of the ram in the position so achieved, the ram, or the rod of the hydraulic jack remain in this position, whereby the support point of the pivot arm automatically moves up. This does not affect the trash compaction in the container because the roll is free to press the trash in the container on account of its own weight.

This check valve on the other hand can also be used to lower the hydraulic jack again when this raised system is being placed in a container to be freshly filled.

A single operating button switching on the roll drive is required for the actual operation; this button is mounted to an operating cable or the like which may be fastened to a spatially fixed crossbeam. Thereupon the roll shall automatically move to-and-fro over the trash on account of the limit switches located at the two end positions, the support point of the roll's pivot arm being automatically raised as a function of the filling height at the time.

Moreover the hydraulic jack may be externally actuable; this is required however substantially only when containers are being changed. This actuation therefore is not carried out by the person filling the container but by the help delivering and picking up the container.

To ensure that the roll can also move on relative smooth materials for purposes of compaction, the surface of the roll is advantageously roughened and/or provided with ribs or the like transverse to the roll's direction of motion and hence longitudinal with respect to the roll. These may be flat irons or the like terminating about 15 mm above the surface of the roll in order not to penetrate unduly deeply in the material being compacted and not to tear it to an undue degree.

To ensure the power supply to the roll, a cable reel is appropriately mounted at the upper free end of the telescoping pivoting arm, such as are used in other machines or the like for which electrical cables are continuously extended or shortened.

To prevent that the prestressed material be too tightly pressed into the container near the walls, whereby the container might thereafter be too difficult to unload, advantageously at least one crown means is mounted in the vicinity of the end faces of the roll and circularly surrounding this roll with its upper rim above the roll surface. In this manner it becomes possible that the crown means presses into the material in the vicinity of the container wall and thereby practically limits the roll's pressing range, whereby excessive stresses between the material and the wall inside surfaces of the container cannot take place. To so control collisions with the wall in the event of side forces, the two roll end faces advantageously are provided with outwardly curved walls or covers which guide the roller impacting the container wall back into the center.

The above embodiment is especially suited for large containers because it requires some cost in construction and requirement in space.

An embodiment especially economical for smaller containers contains a pivot arm divided by at least one hinge joint the vicinity of which comprises at least one stop means preventing the complete straightening of the pivot arm, whereby the two segments of the pivot arm adjoining the hinge joint subtend an angle less than 180° for the extended position of the roll.

This arrangement makes it possible to fold together the segments of the pivot arm connected by the hinge joint during a to-and-fro motion of the roll on the trash to be compacted, whereby the extending length of the pivot arm is varied in a most simple manner and the roll is capable of carrying out its motion on the trash in the container.

One obtains an especially simple construction for the hinge joint if one part of it is designed as a fork which is engaged in-between by the other hinge joint part, both parts being held together by a pin passing through them. In this embodiment the stop means can be formed in an especially advantageous manner by another pin located outside the hinge joint pin and passing through an outer fork section. That part of the hinge joint which engages the fork in such an arrangement comes to rest at the end of the motion of extension of the pivot arm against this stop pin, whereby further extending motion is prevented and an angle less than 180° is retained, so that the subsequent straightening of the pivot arm is made possible during the reverse motion of the roll.

A pivot arm of the kind described above can also be used in the previously described arrangement wherein the pivot arm with ever shorter length moves in a pendulum-like manner past the post arranged midway in the container. Such an application however assumes that the support point for the pivot arm is at least such a given height above the last trash layer in the container, possibly above the rim of the container, that corresponds to one segment length of the pivot arm, so that in the course of those displacements of the pivot arm where the tip of the angle between the segments is down, these segents cannot bore into the trash, rather the hinge joint is merely moved above the trash. This would require a relatively high post and hence a larger and heavier construction.

It is therefore especially advantageous to make the pivot arm displaceable only on one side of the post and to provide that within this range of motion the tip of the angle formed by the segments of the pivot arm be upward.

One obtains in this manner that the hinge joint can only move upward when being flattened, whereby collisions with the trash or the container bottom are impossible. At the same time it becomes possible that no more is required for the position of the pivot arm support point than being slightly above the upper trash layer, possibly above the container rim.

As the roll width must be less than or equal to that of the trash to be rolled over, it will be especially advantageous to mount the post at one of the narrow sides of the container as thereby the roll width can be smaller than or equal to the inside width of the container. In this manner the roll itself may be kept relatively narrow, whereby it will be economical in manufacture. On the other hand the roll then must cover a longer path than if the post were mounted at one of the wide sides of the container. The pressure exerted by the roll on the trash however is just as high for the narrower and far more economical roll as for the other design.

An especially advantageous embodiment is obtained by dividing the pivot arm into a total of three segments between which provision is made for two hinge joints.

Thus it is possible in such an embodiment to keep the hinging of the individual segments and hence the motion of the hinge joints upward relatively small, whereby no excessive clearance height will be required even when introducing the roll into the container, i.e. when it is pivoted or slipped over the container rim.

It is especially advantageous in this respect with regard to removing or inserting the roll that the first pivot arm segment adjoining the support point at the post is approximately vertical, as the second segment joins the first at a right angle, and as in turn the third segment will join at a right angle and downward the second, the third segment hanging from the second together with roll containing its drive means inside of it. To maintain the right angle between the first and second segments, a bracing means is appropriately provided in the region of the hinge joint which supports the second segment when at a right angle to the first.

In order to displace the pivot arm into this position for removing and inserting the roll, the hoisting means arranged underneath the support point at the post may load the end of a traction cable or the like by means of which and using a sector-roller the first segment joining the support point can be pulled into its vertical position. The sector-roller ensures that regardless of the pivoted position of the first segment, the force shall act on the same lever arm.

The hoisting means for vertically aligning the first segment of the pivot arm can advantageously consist of a gear-rack of which the housing is mounted in articulating manner in the lower area of the post and to this post. The upward pointing free end of the rack can be connected to the traction cable which is guided over the sector roller. The rack is acted on by a gear and handcrank, where the gear is rotatably mounted in the rack's housing. The gear-rack side which is away from the traction cable is fixed either to the sector-wheel roller itself or in the vicinity of the sector-roller side away from the gear-rack to the first segment of the pivot arm which is to be erected.

The sector roller itself is mounted solidly to the first segment of the pivot arm and moves together with it.

In this manner there is no relative motion between the traction cable and the sector-wheel roller when the first segment of the pivot arm pivots, rather the traction cable is deposited only in part on the periphery of the sector-roller or lifted off it.

In order to adapt the equipment of the invention to various container heights, it is advantageous to have a variable post height. A simple and sturdy design is obtained in this regard if the post in turn consists of two sections which are mutually displaceable in the longitudinal direction and which preferably engage one another in telescoping manner and which can be fixed in various relative positions.

If use is made of telescopically engaging sections, the fixation may be easily accomplished by plugging transverse indexing pins into coincident clearances in both sections.

This embodiment offers the advantageous possibility regarding such an adjustment in height that the described hoisting means, in particular in its design as a gear-rack, can be used to raise and lower the movable upper post section. To that end an articulating joint is provided at the upper movable post section, to which the upper end of the gear rack can be selectively hooked up. This articulating connection may consist of a simple hinging pin passing through on one hand the upper end of the gear rack and on the other hand a bracket or the like fixed to the upper movable post section.

In order to connect the upper end of the gear rack with the upper section; of the post, the traction cable must be detached from the gear rack. Accordingly the connection with the gear rack end may appropriately consist of a shackle means. At the same time however a stop means between the first segment of the pivot arm and the upper section of the post is provided in the area of the pivot arm support point for a vertical alignment of both parts, so that when detaching the traction cable, the pivot arm shall not flip over. This stop means can consist of of a pivoting stop bar or the like, which is supported at the upper post section and engages a slot or the like of the first section when the latter is in its vertical position.

However the stop means described above is required only when there are special reasons for changing the height for the erected state of the first pivot arm segment. In such a case the weight of the roll acting through the lever arm of the second segment on the post must be moved concurrently.

It is therefore advantageous that the adjustment in height of the post take place for the roll being lowered, namely either inside the container or else resting elsewhere. The deposition of the roll and the support so achieved permit detaching the traction cable without thereby having to fix the pivot arm. As regards the height adjustment itself, only that part of the weight of the upper post section or of the pivot arm need being moved.

In order to permit pivoting motion, for the various height settings between the upper and lower post sections, of the first pivot arm segment by means of the traction cable, provision is further made for mounting cable hooks in the height spacings of the individual indexing boreholes or clearances in the post and at corresponding distances in the first segment of the pivot arm, wherein the upper end of the traction cable will be hooked up in accordance with the corresponding height adjustments of the particular case. In this manner the gear rack by means of its housing can remain spatially fixed to the lower post section at the various height settings of the upper post section.

In order that for this embodiment as well the trash compaction take place automatically and to prevent the roll from running into the container walls, herein too use is made of an automatic reversing means. At least two limit switches for the particular reversal are provided, which can be actuated by cams moved through a drag line, the one end of the drag line being spatially fixed to one pivot arm segment whereas its other end acts on the other pivot arm segment or on a cam displaceably guided at the post, the drag line passing over the hinge joints on their outer surfaces.

In this manner one achieves that the drag line will be pulled when the hinge joint is flattened, whereby the displaceably guided cams undergo a motion accordingly. For complete hinging at one of the end positions these cams therefore are moved against one of the limit switches which ensures a directional reversal, whereas when the pivot arm is straight, the other limit switch will be actuated correspondingly.

It is advantageous in this regard that the drag line be a flat band because such a band can be made to pass in especially wear-resistant manner over fixed pins or the likes. A flat wear-resistant plastic band is appropriate.

To ensure that there shall be a particular reversed motion during the stretching of the pivot arm, provision may be appropriately made for a return spring acting on the cam.

However, it is equally possible to at least also make use of the angular motion of the first pivot arm segment toward the post for the actuation of the limit switches and accordingly to mount the limit switches on the post and the end of the drag line to one of the pivot arm segments; it is especially advantageous however that use be made of the hinge joints between the pivot arm segments for the actuation of the limit switches, so that consequently the cam guidance means are mounted on the first pivot arm segment. If the pivot arm consists in the manner described of three segments, the other end of the drag line appropriately is mounted to the third pivot arm segment so as to achieve as large as possible a cam stroke through the use of the hinging motion of the two hinge joints.

It is especially advantageous to guide the drag line over the stop pins of the hinge joints, as these stop pins are relatively far outside the hinging point for the straightened condition and also outside the outer walls of the individual pivot arm segments. In order to convert the traction thus exerted on the cable into as large as possible a cam stroke, the drag line appropriately passes underneath a direction-changing pin in the vicinity of the particular hinge joint fixed to the next pivot arm segment, where said reversing pin keeps the drag line near the wall of the pivot arm. In this manner the drag line is guided parallel over most of the length of the particular pivot arm to the particular pivot arm segment and is moved away from the stop pin only in the area of the hinge joint by means of this stop pin.

The cams appropriately are seated on a guide bar displaceably arranged on spatially fixed bearings, the drag line acting on one end of the guide bar and the return spring designed as a tension spring acting on the other end. In this manner the guide bar is reciprocated in its bearings by the drag line for every hinging motion of the pivot arm.

The arrangement of the invention of the cams and of the drag line in particular permits adapting in the most simple manner the pivotal excursion of the pivot arm to various container sizes. This is achieved in that the cams are adjustably arranged on the guide bar and can be locked in their particular positions. This locking for instance can be implemented by the guide bar penetrating boreholes in the cam and by the cams being tightened by tightening screws to the guide bar. Depending on the adjusted positions of the cams on the guide bar, the pivot therefore carries out a more or less pronounced pivotal excursion, it being moreover wholly feasible to restrict this motion to one side only and thus to achieve that either a container can be set up so as to be removable from the post, or that only part of the container contents is loaded by the roll.

It is appropriate to mount the limit switches at the two mutually opposite ends of a switch box in the area of the path of motion of the cams, where the switch box may be mounted between the bearings of the guide bar at the first pivot arm segment.

An especially simple embodiment is obtained by replacing the previously described drag line by a hydraulic control unit. Appropriately to this end a hydraulic control unit will be so arranged in the region of the post support point that it will always act in articulating manner by one of its ends on the inside of the hinge and with its other end in articulating manner on the pivot arm segment supported at the post, whereby the partial segments of the pivot arm and of the post, which always extend from the support point to the actuation points of the hydraulic control unit form a triangle with these actuation points. Accordingly an extension of the hydraulic control unit effects a lifting of the pivot arm, and vice-versa.

It is enough, when using a hydraulic control unit, that the pivot arm consist of two segments, of which the roll-bearing segment is made straight while the segment joining the post consists of two rectilinear elements rigidly connected together at a mutual angle. In this manner and for the lowered state of the roll, the element away from the support point at the pivot arm may extend about horizontally, whereby the overall system is relatively compact in operation. Moreover a relatively advantageous weight distribution is thusly achieved during lifting or lowering of the roll. It is appropriate in this regard that the angle subtended by the two elements be about 135°. To further reduce the cantilever loads and hence be able to keep the hydraulic control unit small, it is further advantageous that the post consist also of two straight elements rigidly connected together, of which the lower one is vertical and is joined at an angle by the second element comprising the pivot arm support point and pointing away from the roll to the outside, the angle subtended between these two elements being about 150°.

The actuation of the limit switches to effect the reversal of the direction of rotation of the roll can further be simplified in that the element of the first pivot arm segment adjoining the roll bearing segment comprises a push bar parallel to this element which projects the first element by its end facing the element joining the support point and is provided there with two adjustable cams for acting on the limit switches. The limit switches in this case are appropriately mounted on a support means arranged on this element.

To actuate the push bar, the straight segment of the pivot arm appropriately is provided with an extension in the area of the hinge joint which projects beyond this hinge point and at the end of which an intermediate bar is supported in articulating manner, and the other end of which acts in articulating manner on the associated end of the push bar.

BRIEF DESCRIPTION OF THE DRAWINGS

The invention is explained below in further detail in relation to the illustrative embodiments of the drawings, wherein.

DESCRIPTION OF THE PREFERRED EMBODIMENTS

Figure 1:
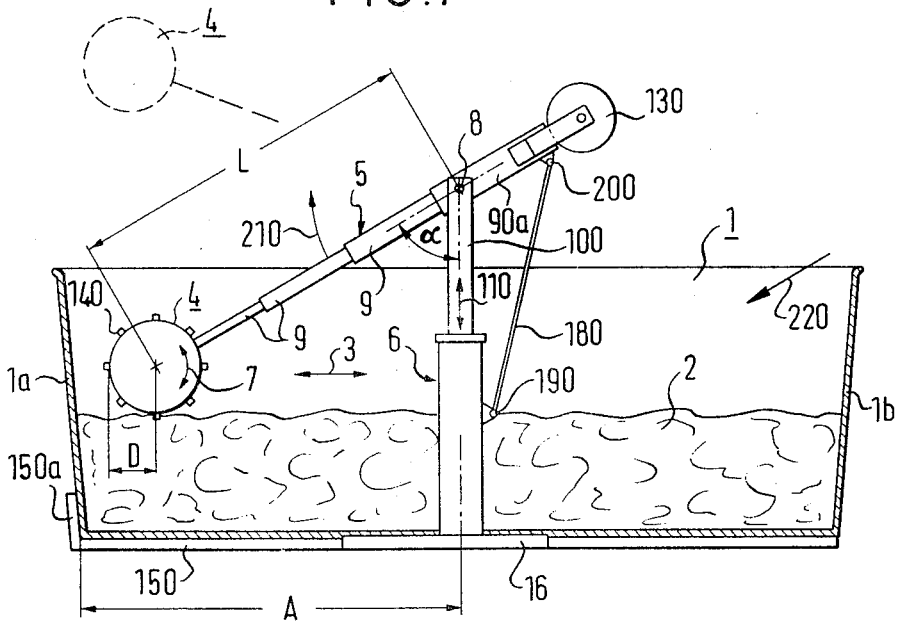
FIG. 1 is a sideview in partial section of an illustrative embodiment of the apparatus of the invention.

A reciprocating compacting roll 4 is provided on the trash 2 located in the container 1 shown in FIG. 1 and moves in the direction of the arrow 3, being mounted in rotatable manner to the free end of a pivot arm 5 supported in articulating manner from a post 6. The compacting roll 4 operates in driven manner, whereby it can rotate in the sense of arrow 7 in order to carry out the motion in the direction of the arrow 3 on the trash 2.

The pivot arm 5 is supported in articulating manner at 8 from the upper end of the post 6 and consists of individual seqments 9 telescoping into each other.

The post 6 is equipped with a hydraulic jack 100 permitting movement up and down the support point 8 in the direction of the arrow 110.

Figure 3:
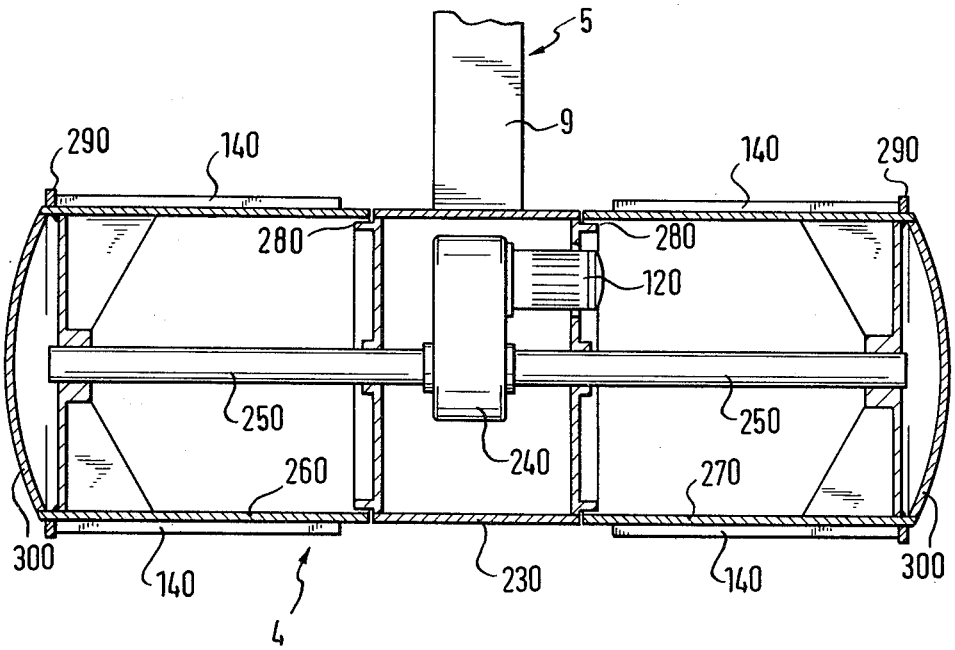
FIG. 3 is a section on an enlarged scale of the compacting roll of the apparatus of FIG. 1.

The drive means for the roll 4 is located within same (FIG. 3). To apply the power to the drive motor 120 arranged therein, a cable reel 130 is mounted at the upper free end of the pivot arm 5.

The surface of the roll 4 is provided with ribs 140 extending transversely to the direction of motion of the roll, i.e. in the longitudinal direction of the roll 4. The purpose of these ribs is to ensure proper motion of the roll also on relatively smooth materials.

The post 6 comprises a base plate 150 underneath the container 1 and hence supporting it. This base plate 150 is provided with a stop rail 150*a* abutting one end face of the container from below and providing a rest for the container when in operation, as indicated. The base plate 150 is directly connected with a post plate 16 of the post 6.

Figure 2:
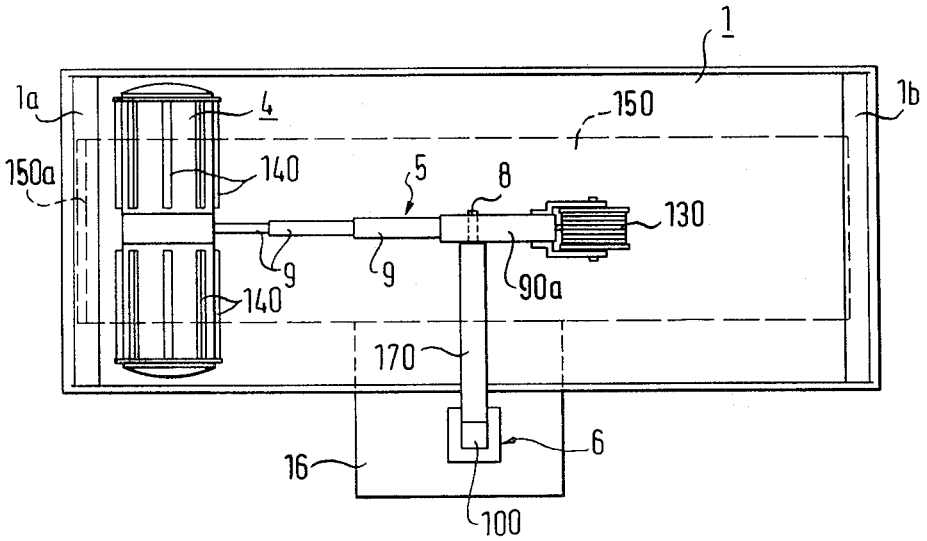
FIG. 2 is the top view of the apparatus of FIG. 1.

The top view of FIG. 2 shows these relations more clearly. FIG. 2 moreover discloses that the hydraulic jack 100 comprises at its upper end an arm 170 reaching over the container and at the end of which is located the bearing 8 for the pivot arm 5. As shown, the post 6 is arranged midway in the longitudinal direction of the container 1.

In the embodiment shown, the length L of the pivot arm 5 is so chosen in the extended position in addition to the radius $\frac{1}{2}$ D of the roll that this total dimension is somewhat less than half the length A of the container, whereby no collision between the roll and the container wall can take place even when the pivot arm 5 is in the horizontal position.

The drive motor for the roll 4 is reversible, its direction of rotation being reversed by (omitted) limit switches. The hydraulic jack 100 moreover is so designed that when the pivot arm 5 in its fully telescopically retracted position passes the post 6, the pivot arm moves against a stop means, whereby the ram or that part of the hydraulic jack bearing the arm 170 and hence the support point 8 of the pivot arm will be upwardly displaced by the presently attained measure of fill. In this position, the hydraulic oil is displaced and retained in the manner described by a check valve, whereby that part of the hydraulic jack which bears the support point 8 cannot drop in the course of the further motion of the pivot arm. In this manner the support point 8 is raised automatically as a function of the level of filling.

In order to have the capability of easily lifting out and inserting the roll 4, a segment 90*a* bearing the cable reel 130 projects beyond the support point 8 on the other side of the roll 4. This segment is connected by means of a rod system, a chain or the like at its end 190 away from the support point 8 in articulating manner with the post 6, where the rod system or the like acts in articulating manner on the segment 90*a* at 200. If now the hydraulic jack 100 moves up, then the roll 4 will carry out a substantial pivoting motion in the direction of the arrow 210 and in this manner can easily be removed from the container, and vice-versa.

Accordingly the operation of the described equipment is as follows: When the container 1 is set on the base plate 150, this motion taking place in the direction of the arrow 220, the hydraulic jack 100 is in the high-up position and the roll 4 is pivoted in the upward sense, that is, it assumes approximately the position indicated in dashed lines in FIG. 1. Once the container 1 has been set on the base plate 150, and has come to rest against the stop rail 150*a*, the hydraulic jack 100 is lowered, whereby the roll 4 moves down onto the container bottom.

Next trash is filled in and the drive for the roll 4 is switched on. The roll now moves in the direction of the arrow 3 toward the trash 2, its direction of rotation being reversed by limit switches actuated when a given angle alpha between the longitudinal axis of the pivot arm 5 and the vertical is reached. This also determines the particular roll end position in the vicinity of the end faces 1*a* and 1*b* of the container 1. Every time the roll 4 moves past the post 6, namely when the pivot arm 5 is widely retracted, this pivot arm moves against a stop means which displaces that part of the hydraulic jack 100 that bears the pivot arm support 8. As already described, a check valve is provided which keeps the hydraulic jack in the position so assumed. In this manner the support point 8 is lifted automatically by the size of the particular filling amount. The check valve also can be used to lower the hydraulic jack.

If now the filled container must be removed, the hydraulic jack 100 is raised again, and next the roll 4 is pivoted out of the container 1. Once this is done, the container can be removed obliquely upward in the direction of arrow 220.

FIG. 3 is a section of the design of the roll 4 of the apparatus in FIG. 1 and 2. As shown in FIG. 3, the roll 4 consists of a center section 230 rigidly fixed to the lower segment 9 of the pivot arm 5. The section 230 is used as the cover means for a spur gear 240 actuated by the drive motor 120 and in turn driving a shaft 250. The bilateral shaft 250 bears two hollow sections 260 and 270 at both its ends which rotate therefore due to the drive from the motor 120. These hollow sections 260 and 270 comprise ribs 140 on their surfaces and/or are correspondingly roughened. They may freely move with respect to the center section 230 with the insertion of labyrinth seals 280 or the like.

Crowns 290 are arranged in the area of the end faces of the two sections 260 and 270 of the roll 4 and annularly encompass the roll sections; the crowns' upper rims are above the roll surface. As already described, these crowns are used to prevent excessive stresses between the material and the inside wall surfaces of the container. To prevent damaging the container 1 when no trash as yet is in it, these crowns may be provided with cover means in the form of rubber tires.

Figure 4:
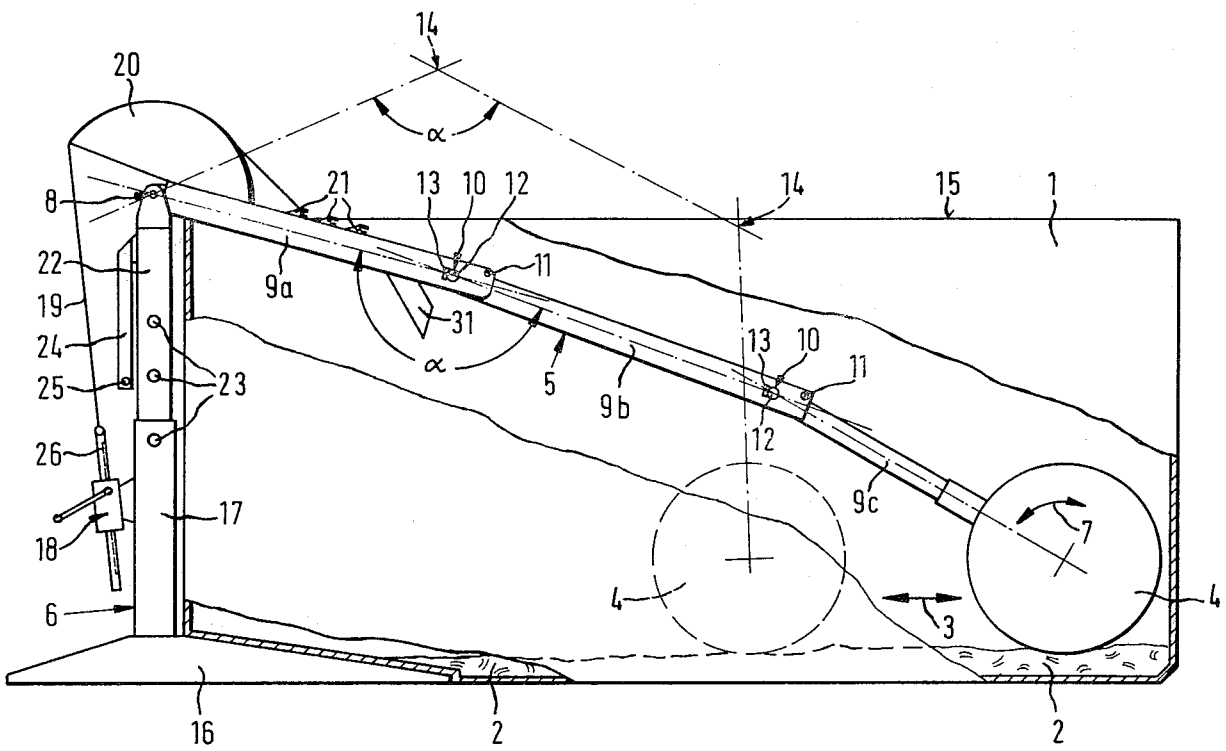
FIG. 4 is a schematic elevation of a further embodiment of the apparatus of the invention.

As regards the embodiment of FIG. 4 through 10, and as shown in FIG. 4, the pivot arm 5 is supported in articulating manner at 8 from the upper end of the post 6 and consists of individual segments 9*a*, 9*b* and 9*c* which are interconnected by hinge joints 10. A stop means 11 is provided in the vicinity of each of the hinge joints 10, which prevents the pivot arm 5 from totally straightening out, whereby the two segments of the pivot arm 5 which are joining at the hinge joint 10 always subtend and angle alpha less than 180° for the extended position of the roll 4 shown in FIG. 4.

Part of the hinge joints 10 is designed as a fork 10*a* (FIG. 6), which engages the other hinge part there between, the hinge being kept together by a pin 12 (FIG. 6) passing through both said parts. The pin 12 is connected in rotationally secure manner by a fastener resting against a flat holding strap 13.

Figure 5:
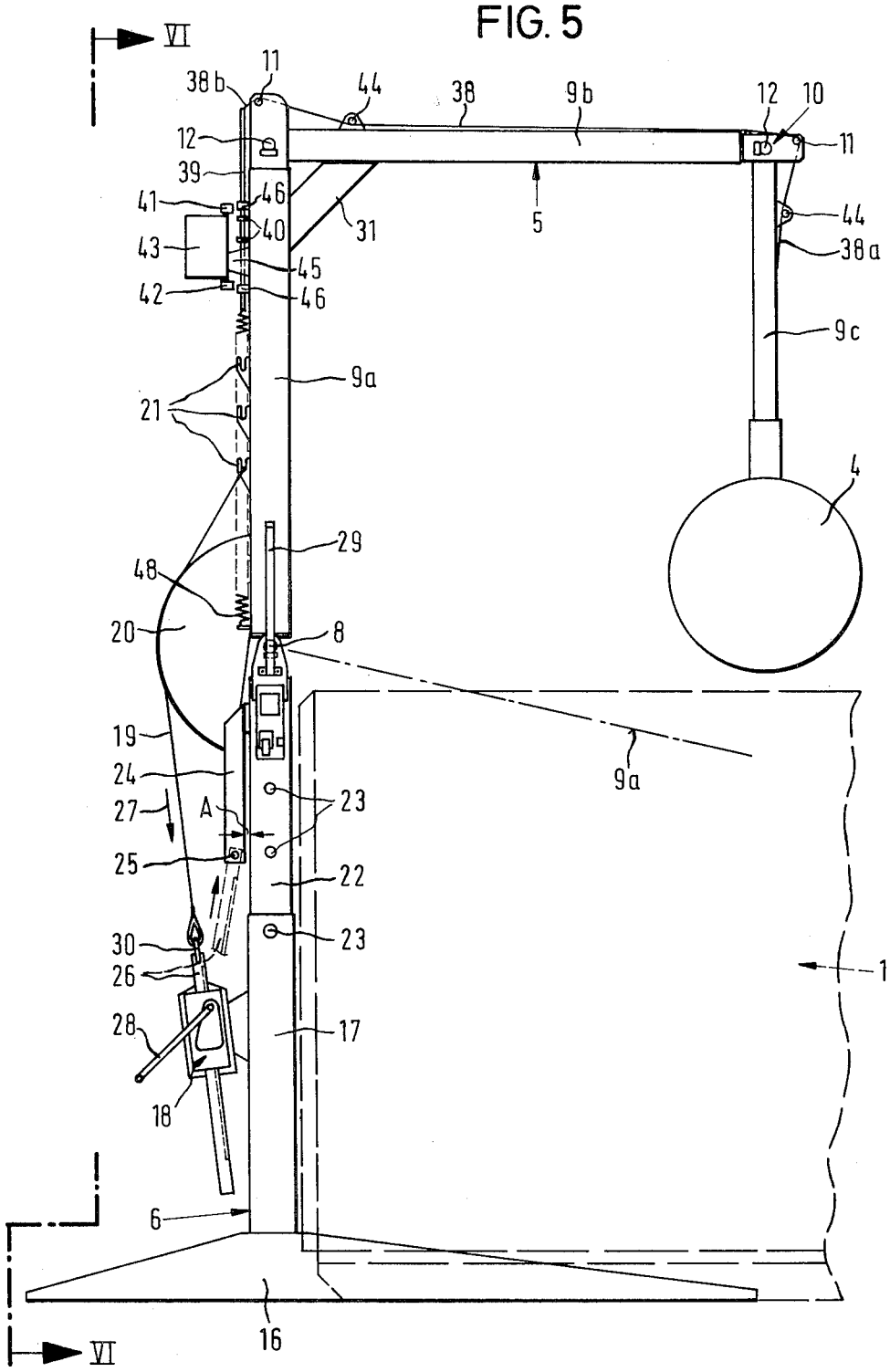
FIG. 5 shows the apparatus of FIG. 4 on a somewhat enlarged scale in the position of the roll used for insertion and removal.
Figure 6:
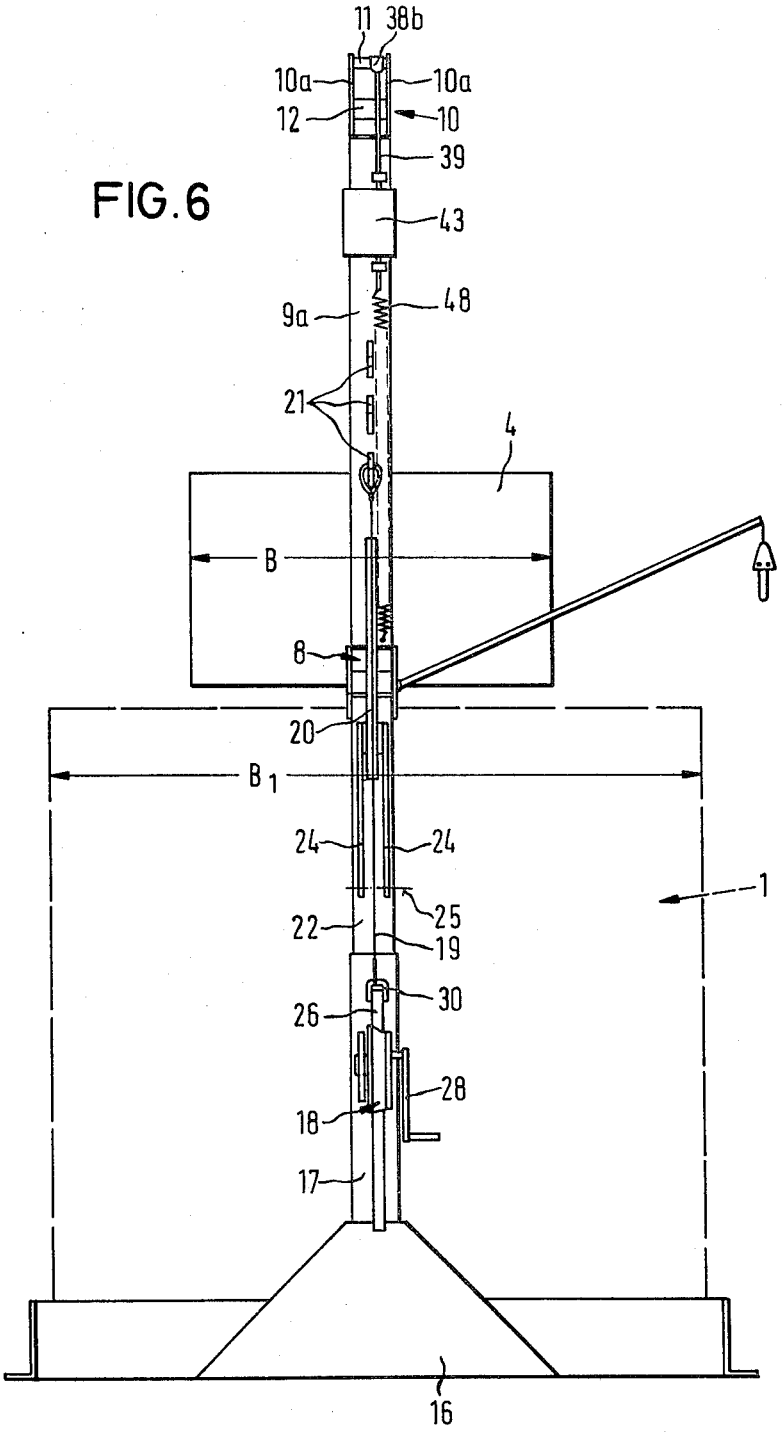
FIG. 6 is the elevation VI/

As shown by FIG. 4 through 6, the stop means 11 in the embodiment shown also is in the form of a pin located outside the hinge pin 12 and also passing through the fork part 10*a*.

In this embodiment too the post 6 is provided with a substantial foot or foot plate 16 providing a rest for the container 1. In the embodiment shown, the post 6 is located at the narrow side of the container 1, the pivot arm 5 being displaceable only on one side of the post 6, the tip 14 of the angle alpha being between the individual segments 9*a* through 9*c* at the top, as shown. For a motion of the roll 4 into the position shown in dashed lines, the pivot arm 5 kinks upward, so that the tips 14 also move up, ie; they cannot be moved down against the container wall or the trash. At the same time it is possible for the pivot arm support point 8 only to be slightly above the rim 15 of the container 1.

A hoisting device in the form of a gear rack 18 is mounted in spatially fixed manner to the lower section 17 of the post 6 connected to the base plate or foot 16 for the purpose of lifting out or inserting the pivot arm and acts by means of a traction cable 19 which is guided over a sector roller 20 and mounted to a cable hook 21 on the first segment 9*a* of the pivot arm 5 joining the support point 8. Three cable hooks 21 are shown for the purpose of the height adjustment which shall be further described below.

A movable section 22 acts in telescoping manner on the spatially fixed part 17 of the post 6; this section 22 may be connected at various heights to the fixed part 17. Both components to that end may be provided with continuous boreholes 23 or the like into which can be inserted stop pins. To move the displaceable component 22 up and down, a bracket 24 is provided on it which in its retracted condition overlaps the component 17; this bracket 24 following the untying of the traction cable 19 can be connected to the upper end of the rack 26 of the gear rack 18.

FIG. 5 shows the apparatus of FIG. 4 in the erected position wherein the first segment 9*a* of the pivot arm 5 is colinear with the post 6. To this end, the traction cable 19 passing over the sector roller 20 was pulled by the gear rack 18 using its handcrank 28 in the direction of the arrow 27 until the erection shown in FIG. 5 was obtained. The apparatus can be locked in the position of FIG. 5 by using a stop means 29 entering a slot or the like in the vertical segment 9*a*.

When the apparatus is in the position of FIG. 5, the roll 4 can be inserted into the container 1 indicated in dashed lines or be removed from it.

To adapt the apparatus to various container heights, the movable component 22 of the post 6 is adjusted by detaching the traction cable 19 fastened by a shackle 30 to the rack 26 from this rack, whereupon the rack is moved into the position shown in FIG. 2 in dashed lines where it is connected by means of a pivot pin or the like provided there with the bracket 24. As already described, the bracket 24 is spaced at its lower end by a distance A from the movable component 22, whereby upon the telescoping of the component 22 into the spatially fixed part 17 the bracket 24 can overlap this part 17. Thereupon the movable component 22 can be moved up and down by the winch 18, and when the desired position is reached, locking can be implemented by means of the boreholes 23.

In the embodiment shown in FIG. 5, the center segment 9*b* is kept at a right angle to the first segment 9*a* by means of a brace 31 supporting the second segment 9*b* in its orthogonal position to the first segment 9*a*. The third segment 9*c* thus hangs also vertically on account of the weight of the roll 4 and of the drive means within it. Even in the absence of locking, the apparatus cannot tip over when the traction cable 19 is hooked up, because the roll 4 keeps the first segment 9*a* always vertical by means of the lever formed by the second segment 9*b*.

For the described height adjustment and corresponding to the particular borehole 23, which corresponds to the selected position, the upper end of the traction cable 19 is hooked into one of the cable hooks 21.

FIG. 6 is the view VI/VI of FIG. 5 and shows in particular the design of the bracket 24 consisting of two components each on either side of the sector roller 20. In this manner it is possible to put a pin through both components along the axis 25 and the upper end of the rack 26 can enter between the two components.

As shown, the roll 4 may be of a width B which is more than trivially smaller than the inside width $B_1$ of the container 1 shown in dashed lines, to prevent excessive compression of the trash being compacted against the container inside walls.

As moreover shown by the FIG. 4 through 6, the stop pin 11 in the position of FIG. 6 is above the hinge pin 12 in the area of the edge of the first segment 9*a* which is away from the second segment, whereby as shown in FIG. 4 the stop pin 11 remains outside the upper edge of the next segment 9*b* when the pivot arm 5 is in the nearly straight position, with the segment 9b resting against the pin 11.

Figure 7:
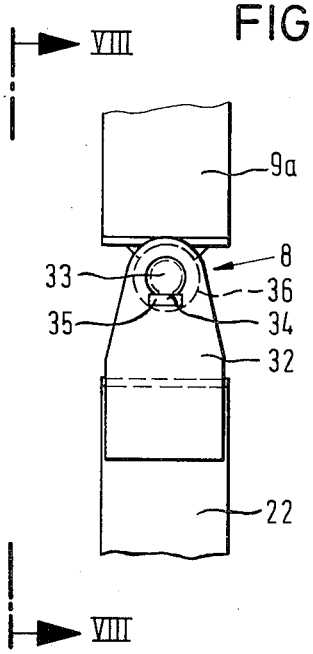
FIG. 7 on a somewhat enlarged scale shows the support point for the pivot arm in the elevation of FIG. 5.
Figure 8:
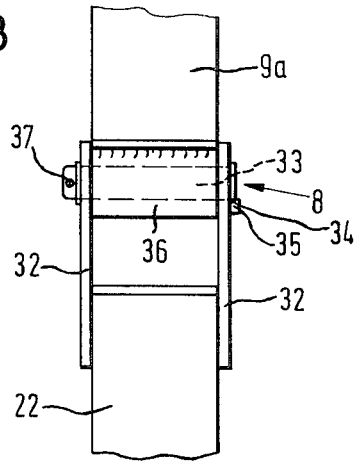
FIG. 8 is the elevation VIII/VIII of FIG. 7.

FIGS. 7 and 8 show an embodiment of the support point 8 which consists of a fork 32 rigidly joined to the movable upper component of the post 6 and through which passes a pin 33 provided with a grip means 34 whereby, together with a flat strap 35 the pin 33 is connected in rotationally secure manner with the fork 32. The pin 33 passes through a bush 36 which is rigidly joined to the adjoining first segment 9a of the pivot arm 5 and which is secured on the other side by a locking pin 37.

FIG. 5 and 6 moveover show a device for the automatic reversal of the reversing drive motor mounted within the roll 4. This device consists of a draw line 38 in the form of a flat plastic band which in the area of the hinge joints 10 and for their straightened out condition is made to pass over the projecting stop pins 11, and of which one end 38a is fixed to the third segment 9c while the other end 38b acts on a guide bar 39 bearing a cam 40 actuating two limit switches 41 and 42. The limit switches 41 and 42 are mounted on a switch box 43 which in turn is secured to the first segment 9a of the pivot arm 5.

The draw line 38 is made to pass underneath the direction-changing pins 44 in the area of the hinge joints 10; these reversing pins 44 are mounted in the next segments 9b and 9c of the pivot arms to brackets or the like. Accordingly the reversing pins 44 keep the draw line 38 between the reversing pins and the next hinge joint in the vicinity of the wall of the pivot arm, ie of the corresponding segment.

Figure 9:
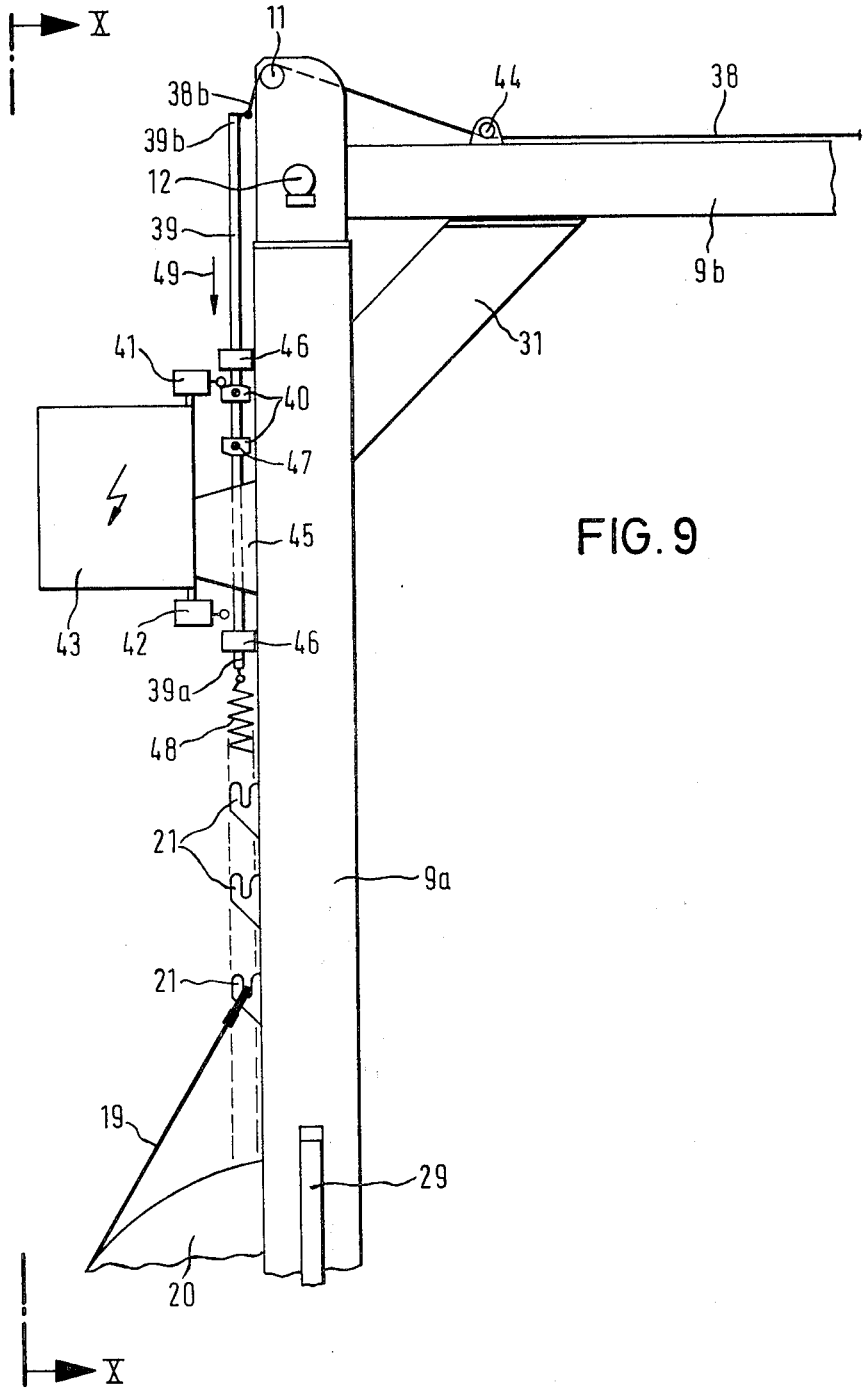
FIG. 9 shows an embodiment of a reversing device on a somewhat larger scale.
Figure 10:
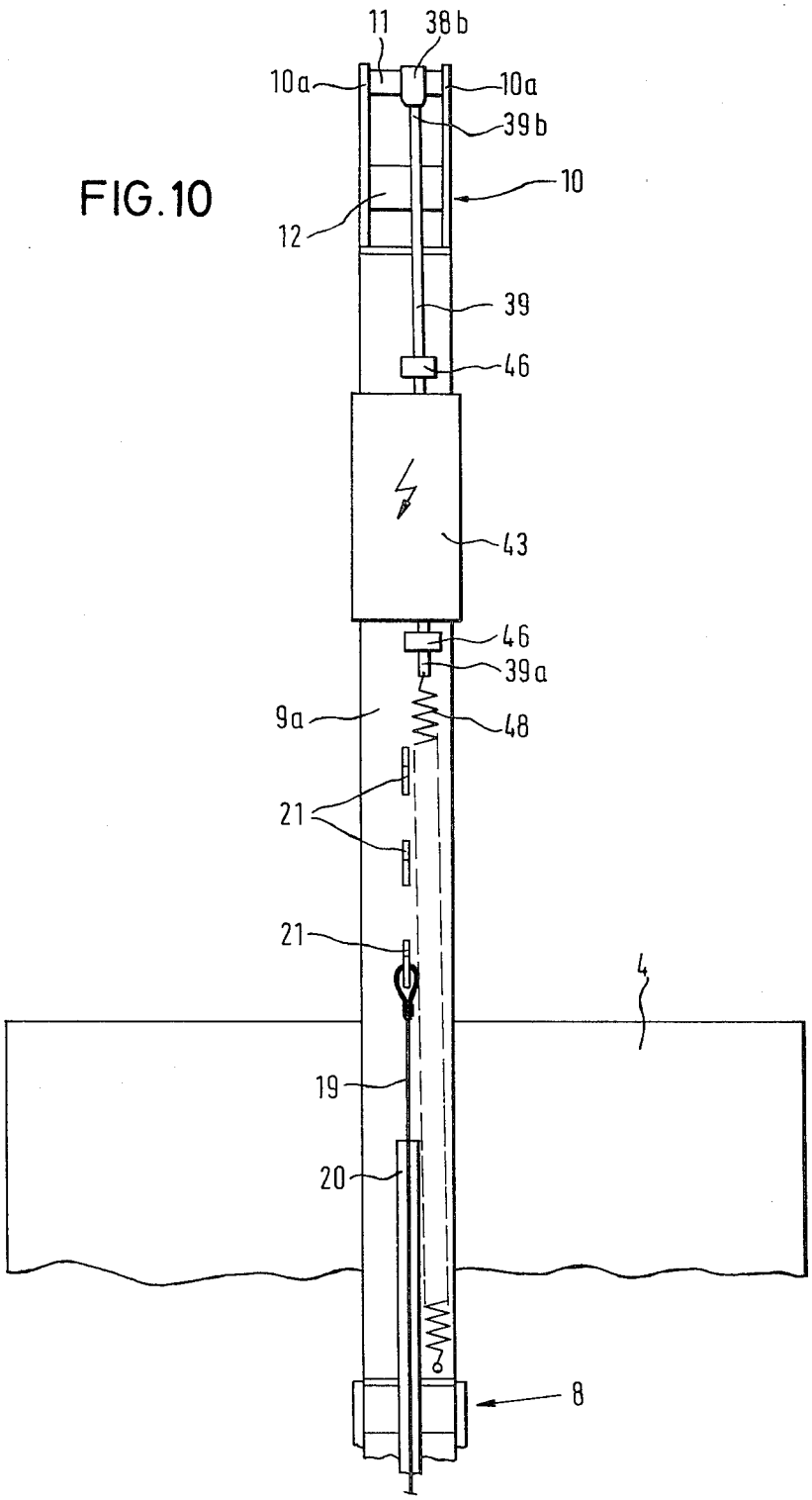
FIG. 10 is the elevation X/X of FIG. 9.

FIG. 9 and 10 show this reversing device on a larger scale and in detail. As shown by FIG. 9, the switch box 43 is connected by a bracket means 45 to the first segment 9a of the pivot arm 5 and bears the two limit switches 41 and 42 at its two ends. The bracket means 45 is located here between two slide bearings 46 for the guide bar 39 which also are mounted to the first segment 9a of the pivot arm.

Cams 40 are mounted on the guide bar 39 between the two bearings 46 and may be provided with boreholes through which the guide bar 39 passes. Tightening screws 47 or the like are indicated by means of which the cams 40 may be locked in their particular settings on the guide bar 39.

A tension spring 48 acts on the lower end 39a of the guide bar 39 of FIG. 9; the other end of the tension spring 48 is fixed in the area of the joint 8 between the post and the first segment 9a at this segment. The tension spring 48 is used as a return spring for the guide bar, and its length permits a maximum large elastic stroke.

The operation of the embodiment of FIG. 4 through 10 is as follows:

When the pivot arm begins to straighten out from the relative positions of the individual segments 9a through 9c shown in FIG. 2 and 6, ie, when the arm starts to approach the position shown in FIG. 4, the deflection of the draw line becomes less in the area of the stop pins 11, whereby the guide bar 39 moves in the direction of arrow 49 toward the hinge 8. At the same time the upper cam 47 departs from the limit switch 41, the motion continuing until the lower cam 47 arrives at the lower limit switch 42. In this position the maximum stretching predetermined by the position of the cams on the guide bar is achieved and the roll's sense of rotation is reversed, whereby the hinging process starts over until the upper cam 47 arrives at the limit switch 41. Then a new straightening motion begins.

Figure 11:
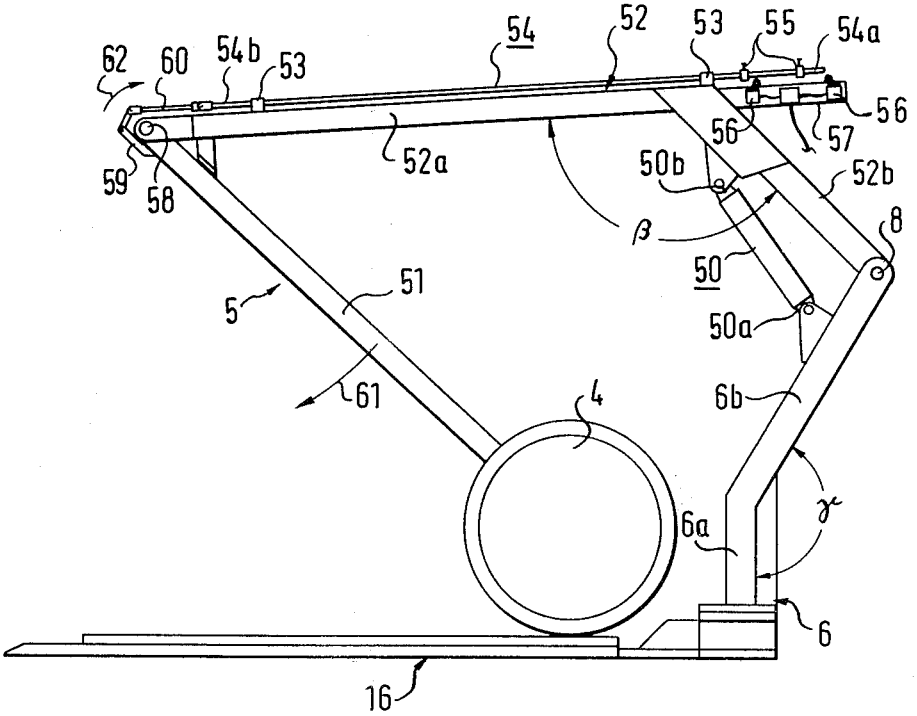
FIG. 11 is an elevation of another embodiment variation of the apparatus of the invention.

FIG. 11 is an elevation of another embodiment wherein a hydraulic control unit 50 is used together with a hinging pivot arm to remove and insert a roll. This hydraulic control unit is so arranged in the area of the support point 8 to the post 6 that one of its ends 50a acts in articulating manner at the inside of the kink on the post 6, while its other end 50b acts in articulating manner on the segment 52 of the pivot arm 5 which is supported from the post 6. The sections of post 6 or the segment 52 of the pivot arm extending from the support point 8 to the actuation points of the hydraulic jack accordingly form together with this hydraulic control unit 50 a triangle, whereby the pivot arm 5 will be lifted when the hydraulic control unit 50 extends.

As shown, the pivot arm 5 consists of two segments 51 and 52, where the segment 5a bearing the roll 4 is rectilinear while the segment 52 joining the post 6 consists of two straight elements 52a and 52b which are mutually connected and subtend an angle beta. The angle beta may be about 135°. The post 6 also in the embodiment of FIG. 11 consists of two straight elements 6a and 6b which are rigidly connected together, where the lower one 6a is vertical, and is joined at an angle gamma by the second element 6b which comprises the support point 8 for the pivot arm 5. This second element 6b points away from the roll 4 and outward, the angle gamma subtended by the two elements 6a and 6b being about 150°. This angular relationship between the segment 52 on one hand and the post 6 on the other permits an especially advantageous application and exploitation of the force generated by the hydraulic control unit 50.

Figure 12:
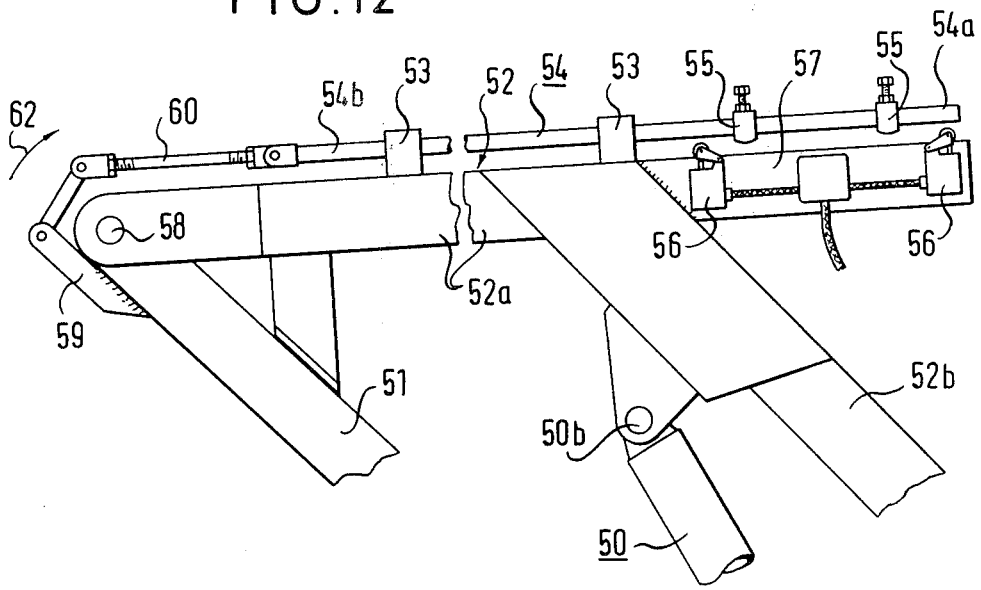
FIG. 12 is a cut-out of FIG. 11 on an enlarged scale.

An especially advantageous actuation device for the limit switches 56 reversing the direction of rotation of the roll 4 is represented moreover in the FIG. 11 and 12. This device consists of a pushbar 54 displaceably mounted in bearings 53 at the element 52a, the end 54a facing the hydraulic control unit 50 projecting beyond the segment 52 and there being provided with cams 55 to act on the limit switches 56. The cams 55 are adjustable on the pushbar 54. The limit switches 56 are seated on a support 57 extending parallel to the pushbar or to the element 52a.

The pushbar is actuated by an extension 59 projecting beyond the hinge joint 58 between the segments 51 and 52 and acting in articulating manner on an intermediate bar 60 of which the other end acts in hinging manner on the associated end 54b of the pushbar 54.

Accordingly, when the straight segment 51 moves in the direction of the arrow 61 out of the position shown in FIG. 11, the end of the extension 59 therefore will move in the direction of the arrow 62 and by means of the intermediate bar 60 pushes the pushbar toward the hydraulic control unit.

The hydraulic control unit can be driven by a motor or by a hand pump, the latter rendering the equipment more economical. By using the hydraulic control unit, it is possible furthermore to provide for a hydraulic lock, as in the embodiment of FIG. 1 through 3, so that when the hydraulic control unit is raised, the roll passing over the trash will maintain the particular lifted position. Lastly it is possible to make use of the hydraulic control unit with suitable throttling, to apply additional forces on the trash.

What is claimed is:

1. Apparatus having a base for compacting trash, in particular cardboard cartons or the like, in an upwardly open container positioned on said base, said container having an upper edge, comprising:

(a) a post (6) mounted on said base;

(b) a pivot arm (5) having a free end mounted in articulating manner to said post above said upper edge;

(c) a compacting roll (4) having a roughened surface rotatably supported from said free end;

(d) means for moving said compacting roll to-and-fro on said trash in said container; and (e) said pivot arm having a telescoped length (L) and means for adjusting said length.

2. The apparatus of claim 1, wherein said roll (4) comprises a hollow cylinder closed at both end faces.

3. The apparatus of claim 2, wherein said roll (4) is made of steel plate.

4. The apparatus of claim 3, wherein said roll (4) is about 80 cm in diameter and of a weight of about 200 kg to 300 kg.

5. The apparatus of claim 1, wherein said means for moving is a drive means (120, 240) for said roll (4) located inside said roll.

6. The apparatus of claim 5, wherein said drive means (120, 240) comprises a spur gear (240) mounted in a center section (230) of said roll (4) rigidly fixed to said free end of said pivot arm (5) together with a drive motor (120).

7. The apparatus of claim 6 , wherein two outer rotatably supported hollow sections (260, 270) of said roll (4) join a spatially fixed center section (230) of said roll.

8. The apparatus of claim 7, wherein said drive motor (120) for said roll (4) is mounted eccentrically to a through-shaft (250) acted on by a spur gear (240), said drive motor (120) located next to said shaft (250) and penetrating one (270) of said two hollow sections.

9. The apparatus of claim 8, wherein said spatially fixed center section (230) of said roll (4) is formed by a housing of said spur gear (240).

10. The apparatus of claim 9, wherein said housing has a cover forming a bearing for a shaft (250) for said rotatable hollow sections (260, 270).

11. The apparatus of claim 1, wherein said pivot arm (5) consists of individual segments (9, 90*a*) telescoping into each other.

12. The apparatus of claim 11, wherein said pivot arm (5) has a support point (8) provided with a hoisting system (100) by means of which said support point (8) for the upper end of said pivot arm (5) is moved up and down.

13. The apparatus of claim 12, wherein said telescoped length (L) of said pivot arm (5) from said support point (8) to said free end plus a radius ($\frac{1}{2}$ D) of said roll is somewhat less than half the length (A) of said container (1).

14. The apparatus of claim 9, further comprising means for limiting the lateral motion of said roll and for reversing the direction of rotation at particular end positions.

15. The apparatus of claim 13, wherein said pivot arm has a segment (90*a*) projecting on the other side of said roll (4) above said support point (8) at said post (6) whereby in the swung-out position of said pivot arm (5) it can be connected in articulating manner by a rod system (180), a chain or the like by means of its end away from said support point (8) with said post.

16. The apparatus of claim 15, wherein a last telescoping hollow segment (90*a*) defines an arm projecting above said support point (8) on the other side, where this arm is acted on by said rod system (180) or said chain.

17. The apparatus of claim 16, wherein said post (6) is located midway with respect to said container (1) and spans the same by an arm (170) at the free end of which is mounted said support point (8) of said pivot arm (5).

18. The apparatus of claim 17, wherein said post (6) is provided with a substantial base plate (150, 160) passing underneath said container (1) and supporting it.

19. The apparatus of claim 18, wherein mutually locking means are provided as connecting means between said base plate (150, 160) and said container (1).

20. The apparatus of claim 19, wherein said base plate (150) is provided at one end face with a stop rail (150*a*) overlapping the corresponding end face (1*a*) of said container (1) and abutting said container (1) in the operational state.

21. The apparatus of claim 20, wherein an arm (170) is at a given distance from said base plate that for said swung-out roll (4), said container (1) is deposited obliquely from above on said base plate (150) and can be removed from it in the opposite direction.

22. The apparatus of claim 14, wherein said drive motor (120) is a reversible motor.

23. The apparatus of claim 22, wherein said reversal of the direction of rotation of the reversible motor is implemented manually.

24. The apparatus of claim 23, wherein an excursion angle (alpha) of the pivot arm (5) is limited and in that for each to-and-fro motion of said pivot arm (5), said hoisting system (100) at said post raises said support point (8) of said pivot arm by a given amount.

25. The apparatus of claim 24, wherein said hoisting system is a hydraulic jack and that when said pivot arm (5) is telescoped inward, it stops and that while said hydraulic jack (100) is in a float position, said jack moves said support point (8) of said pivot arm (5) upward.

26. The apparatus of claim 25, wherein hydraulic oil is retained after being displaced during said upward motion, whereby that part of said hydraulic jack (100) bearing said support point (8) remains in the raised position.

27. The apparatus of claim 26, wherein means is provided to lower said hydraulic jack (100).

28. The apparatus of claim 1, wherein said roll (4) has said roughened surface (140) which is transverse to the direction of motion of the roll.

29. The apparatus of claim 1, wherein said roll (4) is provided with ribs (140) which are transverse to the direction of motion of said roll.

30. The apparatus of claim 29, wherein said ribs (140) consist of flat irons.

31. The apparatus of claim 30, wherein said ribs (140) rise about 15 mm above said roll surface.

32. The apparatus of claim 22, wherein a cable reel (130) is mounted at said free end (90*a*) of said telescopically retracting pivot arm (5) to provide power to said drive motor (120) of said roll (4) and permits automatic winding or unwinding of the cable when said pivot arm changes in length.

33. The apparatus of claim 1, wherein at least one crown (290) is arranged in the area of end faces of said roll (4), circularly surrounding said roll (4) and having an upper rim above said roll surface.

34. The apparatus of claim 1, wherein two end faces of said roll (4) are provided with outwardly curved walls or cover means (300).

* * * * *